US005522513A

United States Patent [19]

Howell

[11] Patent Number: 5,522,513

[45] Date of Patent: Jun. 4, 1996

[54] SEPARATOR DISC

[76] Inventor: Billy R. Howell, 5923 Spring Crossing, San Antonio, Tex. 78247

[21] Appl. No.: 220,162

[22] Filed: Mar. 30, 1994

[51] Int. Cl.[6] ..... B07C 5/344

[52] U.S. Cl. ..... 209/636; 209/212; 209/222; 209/225; 209/231; 209/930

[58] Field of Search ..... 209/636, 642, 209/212, 222, 225, 231, 930

[56] References Cited

U.S. PATENT DOCUMENTS

| | | | |
|---|---|---|---|
| 3,448,857 | 6/1969 | Benson et al. . | |
| 3,454,913 | 7/1969 | Israelson et al. . | |
| 3,710,291 | 1/1973 | Nicoud . | |
| 3,824,516 | 7/1974 | Benowitz . | |
| 4,069,145 | 1/1978 | Sommer, Jr. et al. | 209/212 |
| 4,070,278 | 1/1978 | Hunter | 209/212 |
| 4,083,774 | 4/1978 | Hunter . | |
| 4,106,627 | 8/1978 | Watanabe et al. . | |
| 4,157,297 | 6/1979 | Alth | 209/212 |
| 4,230,560 | 10/1980 | Nakajima | 209/212 |
| 4,248,700 | 2/1981 | Paterson et al. | 209/212 |
| 4,296,865 | 10/1981 | Spodig | 209/216 |
| 4,313,543 | 2/1982 | Paterson | 209/212 |
| 4,362,276 | 12/1982 | Morey | 241/24 |
| 4,459,206 | 7/1984 | Laithwaite | 209/3 |
| 4,743,364 | 5/1988 | Kyrazis | 209/212 |
| 4,752,384 | 6/1988 | Fauth et al. | 209/212 |
| 4,781,821 | 11/1988 | Salmi | 209/214 |
| 4,842,721 | 6/1989 | Schloemann | 209/212 |
| 4,869,811 | 9/1989 | Wolanski et al. | 209/212 |
| 4,906,382 | 3/1990 | Hwang . | |
| 5,047,387 | 9/1991 | Talmy et al. | 505/1 |
| 5,049,540 | 9/1991 | Park et al. . | |
| 5,057,210 | 10/1991 | Julius | 209/212 |
| 5,060,871 | 10/1991 | Brassinga et al. | 241/24 |
| 5,064,075 | 11/1991 | Reid | 209/636 |
| 5,080,234 | 1/1992 | Benson | 209/212 |
| 5,092,986 | 3/1992 | Feistner et al. | 209/212 |
| 5,108,587 | 4/1992 | Walker | 209/212 |
| 5,133,505 | 7/1992 | Bourcier et al. | 241/19 |
| 5,192,359 | 3/1993 | Bourcier et al. . | |
| 5,204,572 | 4/1993 | Ferreira | 310/156 |
| 5,207,330 | 5/1993 | Siesco, Jr. | 209/219 |
| 5,236,091 | 8/1993 | Kauppila et al. | 209/212 |

FOREIGN PATENT DOCUMENTS

| | | |
|---|---|---|
| 0342330 | 11/1989 | European Pat. Off. . |
| 1139506 | 2/1985 | U.S.S.R. . |
| 1487995 | 6/1989 | U.S.S.R. . |
| 8907981 | 9/1989 | WIPO . |

*Primary Examiner*—David H. Bollinger
*Attorney, Agent, or Firm*—Novak Druce Herrmann Burt

[57] ABSTRACT

An apparatus for separating non-ferrous metal particles from residue composed of rubber, dirt, wood, plastic, glass, an the like, as well as the non-ferrous metal particles. The residue is transported by a conveyor belt over a pair of rotating magnetic separating discs which generate a magnetic field flux upward. This magnetic field flux induces an eddy current in the non-ferrous metal particles. The eddy current is a repulsive force to the magnetic field flux, which enables the non-ferrous metal particles to be levitated above the conveyor belt and the other residue material. The rotation of the field accelerates the particles off the side of the conveyor belt, into discharge chutes which collect the separated particles for recycling. The other residue material is collected at the end of the conveyor belt.

14 Claims, 3 Drawing Sheets

SEPARATOR DISC

BACKGROUND OF THE INVENTION

1. Field of the Invention

The present invention relates to metal separators, and more particularly to an apparatus for separating non-ferrous metal pieces from ferrous metals, rocks, glass, rubber, wood and dirt.

2. Description of the Related Art

In this present era of recycling and limited land-fill space, the necessity to reclaim reusable materials from debris and waste has become of the utmost concern to our society. The reclamation of metal materials is additionally important due to the increasing scarcity of these natural resources and the cost-effectiveness of recycling versus mining and purification of metals. To recover metals from debris and waste, the recycling industry has developed numerous metal separating devices.

Ferrous metal pieces are easily removed by suitable magnets which remove the ferrous metals from the debris using attractive magnetic forces to pull the ferrous metals from the debris material. Non-ferrous metals must be removed using alternative methods since they do not contain the magnetic properties of ferrous metals. To remove non-ferrous metals from debris, the recycling industry has developed metal separators that subject the non-ferrous metal materials to a high density, rapidly changing, magnetic flux fields, which induces eddy currents in electrically conductive non-ferrous metal materials. The eddy currents create a repulsive magnetic force in the materials which allows the materials to travel away from the magnetic flux field and consequentially be separated from non-electrically conductive materials in the debris. The magnitude of this repulsive magnetic force is defined by the electrical resistivity of the metal, size and shape of the material, magnetic flux field strength and the velocity and frequency of the rotating magnetic poles creating the magnetic flux field.

Prior devices utilizing the eddy current concept to separate non-ferrous metals from debris have transported the debris along a conveyor belt on which a rotating drum containing the magnetic poles is positioned to rotate in the same plane as the conveyor belt and at the end of the conveyor belt. In this way, the non-ferrous metals are repulsed further away from the other materials in the debris as all the materials in the debris are projected from the conveyor belt. The prior art discloses several inventions embodying this device. Benson, U.S. Pat. No. 5,080,234, utilizes a pair of cylinders, one above the other, rotated synchronously in opposite directions and matched so that the poles of opposite polarity face each other across an air gap. As electrically conductive particles are conveyed across the gap, an eddy current is induced in the particles and they are separated and collected apart from the free falling non-conductive materials in the debris.

Applying the same eddy current principles as Benson is Feistner et al, U.S. Pat. No. 5,092,986. Feistner et al places a rotating drum consisting of magnets, eccentric to a belt drum on which debris is conveyed. Eddy currents are created in electrically conducive particles of the debris as they are conveyed over the rotating drum and through the magnetic flux field. These particles are projected further off a conveyor belt by the repulsive magnetic force. This allows the electrically conductive particles to be separated from the other debris materials. Feistner et al also employs a scraper to remove iron particles, which are attracted to the magnets, from the belt drum to prevent damage. Wolanski et al, U.S. Pat. No. 4,869,811, and Kauppila et al, U.S. Pat. No. 5,236,091, disclose similar eddy current separators as described in the aforementioned patents.

By using horizontally mounted magnetic drums to create a magnetic flux field, the horizontally mounted magnetic drum must rotate at between 1800 to 3500 rotations per minute (RPM) in order to create a strong enough magnetic flux field to induce an eddy current in the non-ferrous metal particles. In order to maintain these high RPMs, a strong motor which consumes extensive energy must be utilized by the separator machine.

In the prior art, the use of horizontally mounted magnetic drums increases the distance between the magnets and the debris which results in the need for greater RPMs to compensate for a decrease in the magnetic field flux strength due to the increased distance. Current separator machines only provide one opportunity for the non-ferrous metal materials to be acted on by the magnetic field flux. This single opportunity results in the possibility of some non-ferrous metal materials not being removed from the other debris materials or the need to rerun the debris through the separator machine. These disadvantages need to be alleviated, in order to make separator machines as cost-effective and as efficient as possible.

SUMMARY OF THE INVENTION

The present invention is a non-ferrous metal separator machine which in a manner to be set forth utilizes the principles of Lenz's Law to separate electrically conductive metals from other debris material such as glass, wood, rubber, rocks and dirt, in a novel and unique manner. In 1834, Heinrich Friedrich Lenz deduced that the induced current will appear in such a direction that it opposes the change that produced it, which became known as Lenz's Law. The present invention causes non-ferrous metal materials, as they are transported along a conveyor belt with debris material, to levitate as they pass above the magnetic field flux created by the novel magnetic separator discs of the present invention. At the same time the non-ferrous metal materials are levitating, they are synchronously rotating with the disc and are thrown off the conveyor belt into novel discharge chutes located at both sides of the conveyor belt. The debris material remains on the conveyor belt as it passes over the magnetic discs and is dumped at the end of the conveyor belt.

The separator machine of the present invention includes a metal frame on which the other components are attached to. A seamless, continuous conveyor belt is positioned to cover the top of the frame. A first motor attached to the frame powers the rearward conveyor belt drum in order to move the conveyor belt. A second belt drum is attached to the forward end of the frame in order to give the belt stability. Two smaller belt drums are located at the forward and rearward ends of the lower portion of the frame to also give stability to the belt.

Magnetic discs are positioned in a longitudinal axis to the plane of the conveyor belt. The magnets are located at the top of the disc at the perimeter. The magnets are contained by a stainless steel ring around the circumference of the disc and a thin sheet of metal on top of the magnets. The thin metal cover allows for the non-ferrous metal materials to be closer to the magnetic flux field than most horizontal drum type configurations. Since the materials are closer to the field, a lesser field magnitude is needed to induce an eddy current in the materials. And since the diameter of the disc is twice that of most horizontal drum type configurations, the disc only has to rotate at a low RPM to create a strong enough field to induce an eddy current in the electrically conductive materials.

The discs are connected to a motor by a shaft attached through the lower center of the disc. The motor, shaft and disc are more likely to last a longer period of time than similar components on a standard separator machine since the present invention is able to operate at lower RPMs.

It is an object of the present invention to provide an improved metal separator apparatus.

It is an object of the present invention to provide a metal separator apparatus that is cost efficient and simple.

It is a further object of the present invention to provide an improved method of generating an eddy current in a non-ferrous metal.

It is a further object of the present invention to provide an improved non-ferrous metal separator apparatus that can separate non-ferrous metal materials from debris.

It is a further object of the present invention to provide an improved method of collecting non-ferrous metal materials.

Other objects and advantages of the present invention will become apparent to one skilled in the art from the detailed description of the invention and the appended claims.

BRIEF DESCRIPTION OF THE DRAWINGS

The present invention is further described in connection with the accompanying drawings, in which.

DETAILED DESCRIPTION OF THE INVENTION

Numerous machines have been brought forth from the inventive minds of the recycling industry to facilitate the separation of metals from debris. As the progression of the metal separator field has evolved to complex apparatuses to separate specific metals such as non-ferrous metals, from debris, sparse attention has been directed toward developing an efficient but simple apparatus to separate non-ferrous metals from debris.

The present invention is a novel apparatus to separate non-ferrous metals from debris in an efficient and simple manner which is unique to the field of metal separating apparatuses. The present invention applies the principles of Lenz's Law in a novel manner, which as of yet has not been disclosed in the prior art, to separate non-ferrous metal particles from debris material in an efficient and simple manner.

What follows is a detailed description of the present invention and the best mode of operating the present invention to separate non-ferrous metal particles from debris.

Figure 1:
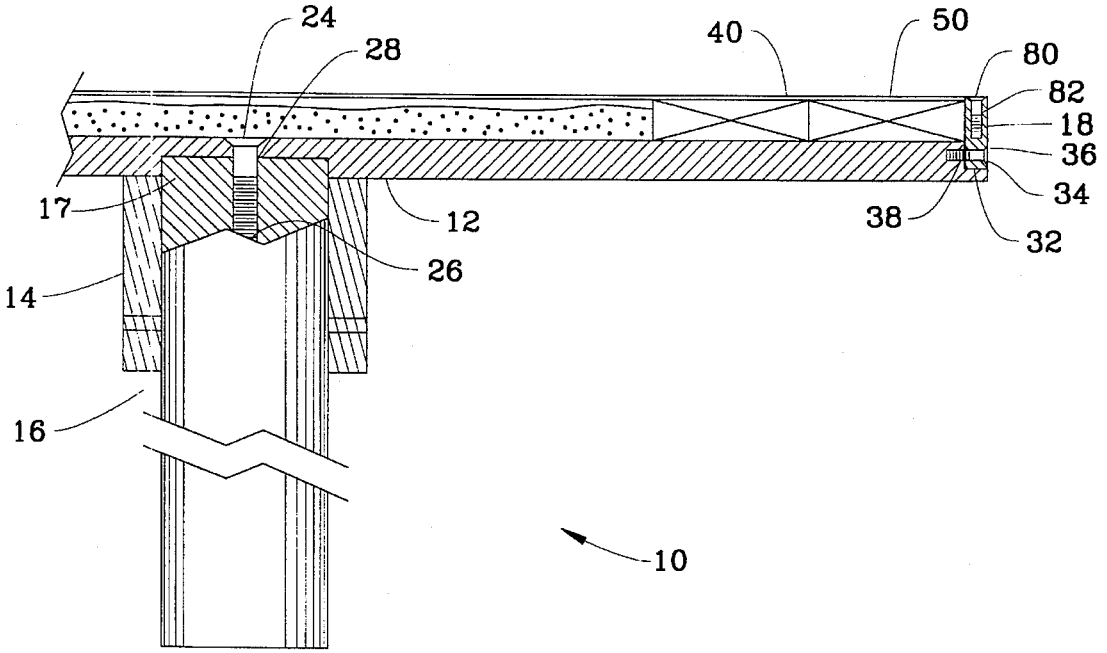
FIG. 1 is a cross sectional view of a magnetic separator disc of the present invention.

There is illustrated in FIG. 1 a cross sectional view of a magnetic separator disc of the present invention. The magnetic separator disc 10 includes a disc body 12, a disc hub 14, a disc shaft 16, a circumferential ring 30, a plurality of permanent magnets 40 and a disc cover 50. The disc body 12 is circular in shape and composed of highly resilient material such as mild steel. In the preferred embodiment of the invention, the diameter of the disc body 12 is 76.2 centimeters and the thickness is 2.54 centimeters.

The disc hub 14 is attached to the disc body 12 by welding the top of the disc hub 14 to the bottom of the center of the disc body 12 so as to have the disc hub 14 perpendicular to the plane of the disc body 12. The disc hub 14 is cylindrical in shape and composed of a resilient material such as mild steel. The disc hub 14 has an open cavity to permit the placement of the disc shaft 16. The disc shaft 16 fills the entire cavity of the disc hub and is positioned therethrough until the top of the disc shaft 16 is resting in an indention 17 of the disc body 12. The disc shaft 16 is attached to the disc body 12 by the coupling of a central disc body bolt 24 to the threaded disc shaft upper bore 26. The bolt 24 is placed through the central disc body aperture 28, which is in the center of the disc body 12, therethrough to the threaded bore 26 and tightened so as to place the top of the disc shaft 16 up against the bottom of the disc body 12, the disc shaft 16 perpendicular to the plane of the disc body 12.

Once the bolt 24 has been thoroughly tightened and the top of the disc shaft 16 is resting up against the bottom of the disc body 12, a disc shaft central bore is drilled through one side wall of disc hub 14, through the disc shaft 16 and then through the opposite side wall of disc hub 14. A disc shaft bolt 28 is inserted in central bore 28 so as to attach the disc shaft 16 to the disc hub 14.

At the periphery of the disc body 12, a circumferential ring 30 is positioned at the side indentation 32, forming a boundary around the circumference of the disc body 12, the circumferential ring 30 substantially perpendicular to the plane of the disc body 12. The ring 30 is an annular wall composed of a very strong material such as stainless steel. The ring 30 is attached to the disc body by a plurality of circumferential ring bolts 34, each of which is inserted through a plurality of circumferential ring apertures 36 to a corresponding plurality of peripheral disc body threaded bores 38. The plurality of ring bolts 34 are thoroughly tightened into the plurality of disc body threaded bores 38 to ensure a complete attachment of the circumferential ring 30 to the disc body 12.

A plurality of permanent magnets 40, in a plurality of rows 42 and 44, are attached to the top of the disc body 12 at periphery. The plurality of magnets 40 are placed up against the circumferential ring 30 which acts as outer barrier for the plurality of magnets 40 and contains them within the magnetic separator disc 10 when the disc 10 is rotating. The plurality of magnets 40 are positioned in alternating polarities around the periphery of the disc body 12. The first row of magnets 42 is place next to circumferential ring with the second row of magnets 44 is then placed next to the first row of magnets 42 leaving a circular void 46 on the disc body 12 which is filled with epoxy. In the preferred embodiment, the plurality of magnets 40 are Neodymium 35 with a physical size of 3.81 cm by 3.81 cm by 5.08 cm. In another embodiment, the plurality of magnets 40 are Neodymium 35 with a physical size of 2.54 cm by 2.54 cm by 3.81 cm.

A disc cover 50 is placed over the top of disc body 12, resting and attached to the circumferential ring 30. The disc cover 50 is attached to the disc body 12 by a plurality of disc lid bolts, which are placed through a plurality of disc cover central apertures to couple with a plurality of disc body central threaded bores 70, 72, 74 and 76. The disc cover 50 is attached to the circumferential ring 30 by a plurality of disc cover screws 80 which are placed through a plurality of disc cover periphery bores 82 to couple with a plurality of circumferential ring periphery bores 84. It is necessary to securely fasten the disc cover 50 to the disc body 12 and circumferential ring 30 in order to restrain the plurality of magnets 40 when the magnetic separator disc 10 is in operation. The disc cover 50 is composed of a resilient material such as stainless steel and in the preferred embodiment, a disc cover 50 composed of stainless steel with a thickness of 1.57 millimeters is used to enclose the top of the disc body 12.

Figure 2:
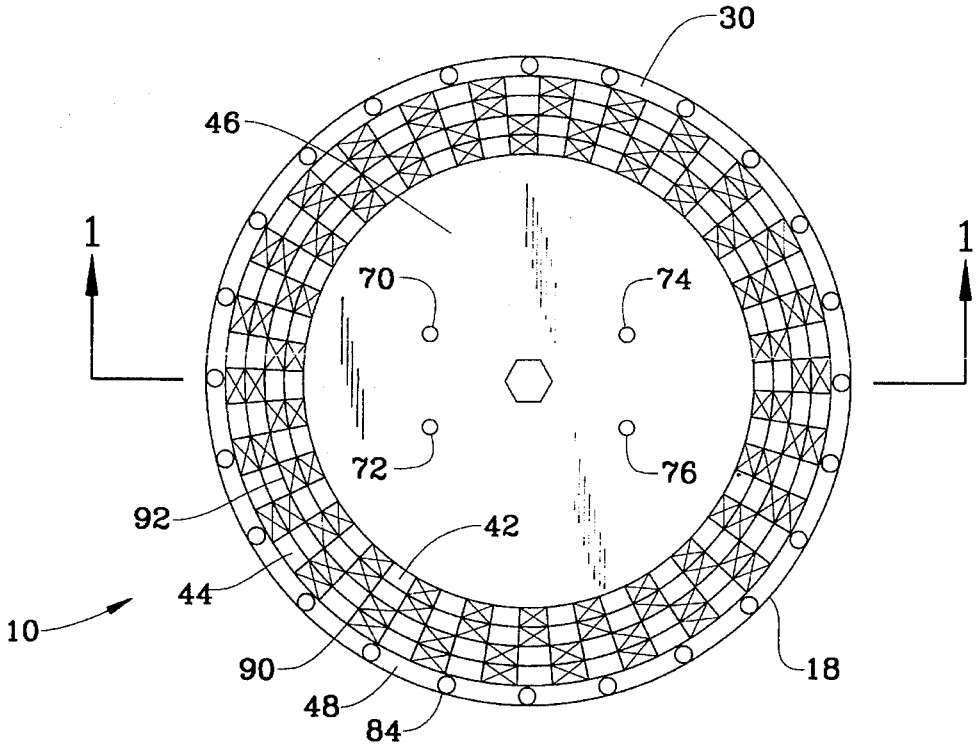
FIG. 2 is a top perspective view of a magnetic separator disc of the present invention.

There is illustrated in FIG. 2 a top perspective of a magnetic separator disc of the present invention. As is illustrated in FIG. 2, the plurality of magnets 40 are divided into a plurality of columns of magnets 48 and a plurality of rows of magnets 42 and 44. In the preferred embodiment, each of the plurality of columns of magnets 48 contains four magnets, with magnets of the same polarity separated by a plurality of insulator units 92. As with each row of magnets 42 and 44, each column of magnets 48 has alternating polarities of magnets. Dispersed between each of thee plurality of columns 48 is a plurality of displacement units 90. In the preferred embodiment, the plurality of displacement units 90 and the plurality of insulator units 92 are composed of wood.

The void 46 of the disc body 12 is defined by the inner edge of the plurality of magnets 40 which creates a circumferential boundary of the void 46. The depth of the void 46 is defined by the height of the plurality of magnets 40 and the face of the disc body 12. The head of the disc body bolt 24 as well as the tops of the disc body central threaded bores 70, 72, 74 and 76 lie above the face of the disc body 12. After the plurality of magnets 40 are set in place, the void 46 is filled with epoxy to prevent movement of the plurality of magnets 40.

The disc cover 50 is placed atop of the disc body 12, lying on the circumferential ring 30. The disc cover is attached to the ring 30 by a plurality of disc cover screws 80 which are placed through a plurality of disc cover periphery bores 82 and coupled to the plurality of circumferential ring periphery bores 84. In the preferred embodiment, there are twenty-four disc cover screws, each screw coupled to one of the twenty four corresponding ring periphery bores. The disc cover 50 is also attached to the disc body 12 by a plurality of disc cover bolts, which are placed through a plurality of disc cover central apertures to couple with the plurality of disc body central threaded bores 70, 72, 74 and 76.

In the preferred embodiment, the plurality of ring periphery bores 84 number twenty four, positioned approximately ten centimeters apart from each other along the top of the circumferential ring 30.. When the disc cover 50 is placed over the disc body 12, the plurality of peripheral disc lid screws 80 are coupled with the plurality of ring periphery bores 84 to tightly attach the disc cover 50 to the circumferential ring 30.

Figure 3:
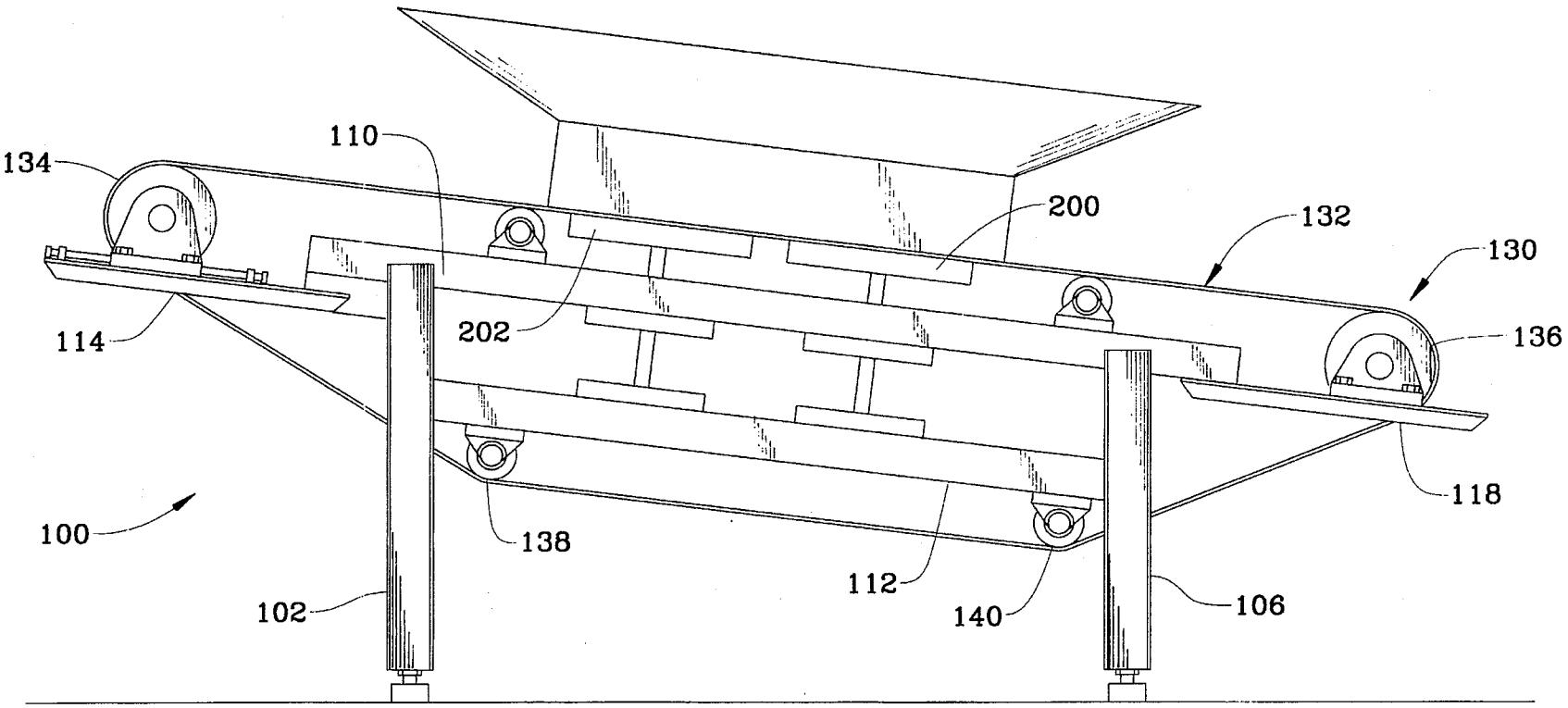
FIG. 3 is a side perspective view of the metal separating apparatus of the present invention.
Figure 4:
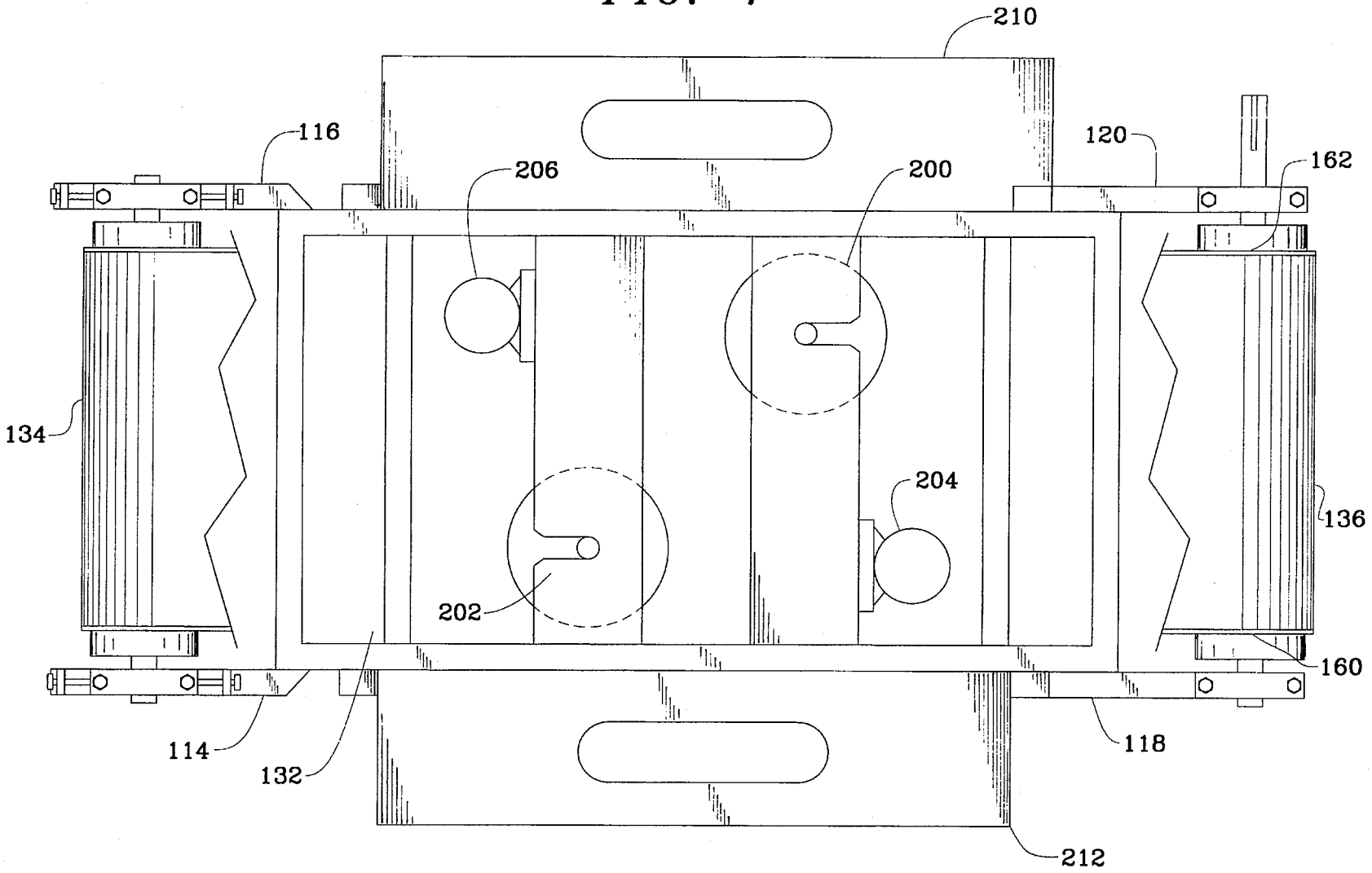
FIG. 4 is a top perspective of the metal separating apparatus of the present invention.

There is illustrated in FIG. 3 a side perspective view of the metal separating apparatus of the present invention and in FIG. 4 a top perspective view of the metal separating apparatus of the present invention. As is illustrated in FIGS. 3 and 4, a skeletal frame 100 is the base for the other components of the present invention. The frame 100 consists of a plurality of forward legs 102 and 104, a plurality of rearward legs 106 and 108, an upper portion 110, a lower portion 112 and a plurality of extension units 114, 116, 118, and 120.

Attached to the frame 100 is a conveyor belt system 130 including a conveyor belt 132, a forward belt drum 134, a rear belt drum 136, a plurality of small belt drums 138 and 140, and a two horse power motor to rotate the belt 132. The forward belt drum 134 is connected between extensions 114 and 116 at the forward end of the frame 100. Rear belt drum 136 is connected between extension units 118 and 120. An extension pulley is attached to rear belt drum 136 by a shaft. Motor is attached to extension unit 114 at a position forward from where rear belt drum 136 is attached to extension unit 114. Motor rotates extension pulley through a pulley belt 154.

The conveyor belt 132 is placed around rear belt drum 136, forward belt drum 134 and the plurality of small belt drums 138 and 140. When the motor rotates extension pulley, rear belt drum 136 is in turn rotated which rotates the conveyor belt 132. The movement of conveyor belt 132 is from forward belt drum 134, toward rear belt drum 136, downward to small belt drum 138, toward small belt drum 140, upward to forward belt drum 134, and then the cycle is repeated.

In the preferred embodiment, the conveyor belt 132 is composed of non-magnetic flexible material such as two ply poly rubber or polyurethane. The conveyor belt 132 is continuous and seamless, having a plurality of ribs 160 and 162 located at each side of the top of the conveyor belt 132, the plurality of ribs 160 and 162 preventing residue from falling off the sides of conveyor belt 132 as the residue is transported on conveyor belt 132.

Conveyor belt 132 also has a plurality of wipers which removes pieces of iron lodged above the plurality of separator discs due to the attractiveness the iron for the magnets. Since the magnet flux field generated by the separator disc is very powerful, iron particles will resist the movement of the conveyor belt 132, the iron particles lodging themselves above the magnet flux field. The plurality of wipers which are positioned equidistance apart from each other on the top of the conveyor belt 132, push the iron particles away from the magnet flux field and off the end of the conveyor belt 132 with the debris.

A first separator disc 200 and a second separator disc 202 are attached between upper portion 110 and lower portion 112 of frame 100. Discs 200 and 202 are positioned near the center of frame 100, with one disc forward to the other disc, and positioned such that substantially the entire width of the conveyor belt 132 is covered both discs 200 and 202. First separator disc 200 is driven by first motor 204 and second separator disc 202 is driven by second motor 206, motors 204 and 206 attached between the upper portion 110 and lower portion 112 of frame 100. In the preferred embodiment, motors 204 and 206 both seven and half horsepower alternating current motors.

Attached to each side of frame 100 is a discharge chute 210 and 212 for collection of non-ferrous metal particles separated from the residue. The chutes 210 and 212 are attached to the upper portion 110 and the lower portion 112 of frame 100. The chutes 210 and 212 are located high enough above the conveyor belt 132 to receive the non-ferrous metal particles as they are levitated and thrown off the belt 132.

In operation, residue is delivered to the front of the conveyor belt of the metal separator apparatus. This delivery of residue may be accomplished by several devices. The preferred device is a variable speed vibrator which distributes the residue evenly over the width of the conveyor belt, and depending on the density of the residue, the vibrator may be regulated to distribute the residue onto the conveyor belt to prevent bridging. Bridging is a condition that exists when a piece of desirable non-ferrous metal material is positioned on top of or under a piece debris, and when the desirable material is discharged, the debris is carried along with it. Vibrators are usually suspended under a hopper allowing for a greater quantity of residue to be stored while the vibrator distributes residue to the conveyor belt at a pre-determined rate.

If a stand alone conveyor belt is utilized to deliver residue to the conveyor belt of the metal separator apparatus, several problems may arise if a vibrator or some other regulating device is not utilized in conjunction with the stand alone conveyor belt. These problems may include uneven flow rate, bridging and desirable non-ferrous metal material being piled to high atop debris to come in contact with the magnetic flux field.

Whichever device is used, a magnetic head pulley should also be utilized in order to remove from the residue as much ferrous metals as possible. Ferrous metals will be attracted to the magnetic separating discs and will accumulate on the conveyor belt, hindering the removal of non-ferrous metal materials.

Once the residue is delivered to the front end of the conveyor belt, it is transported over the magnetic flux field created by the magnetic separator disc, or discs, if two discs are used as in the preferred embodiment. A magnetic flux field will induce an eddy current field in non-ferrous metals when the shaft rotating the magnets reaches fifty RPMs or higher. The magnetic separator discs of the present invention operates at nine-hundred to eleven-hundred RPMs which is considered slow when compared to most other non-ferrous metal separating machines. The other machines operate at higher RPMs (anywhere from eighteen-hundred to thirty-five-hundred RPMs) because the magnets are positioned on a horizontally mounted drum which is fifteen to thirty-eight centimeters in diameter as compared to the present invention, where the diameter of the disc is seventy-six point two centimeters. These smaller diameter drums must rotate at higher RPMs in order to generate a sufficient magnetic flux field which must be strong enough to induce an eddy current in the non-ferrous metal materials. The higher rotation of horizontally mounted drums used by other machines results in an increase in the temperature of the machine resulting in heat related problems.

As the residue is moved forward on the conveyor belt over the magnetic flux field of a disc, non-ferrous metal material is levitated above the belt and carried in the direction of rotation of the disc and then thrown off the belt into a discharge chute, the discharge chutes located on both sides of the conveyor belt. The debris that is left in the residue is then ejected off the end of the conveyor belt into a collection bin.

The non-ferrous metal particles have a tendency to bounce and spin in a zig zag course off the belt. The levitation of the non-ferrous metal particles, coupled with bouncing and zig and zag course acts to prevent the non-ferrous metal particles from knocking off or taking with it, rocks, glass, wood rubber, and other debris materials. The plurality of ribs on both sides of the belt also prevent debris material from rolling or being knocked off the sides of the belt.

The residue may contain some ferrous dust or particles which were not removed from the aforementioned magnetic head pulley. This ferrous dust or particles will cling above the magnetic flux field, allowing the conveyor belt to move beneath it, and interfering with the separation of non-ferrous metal particles. The plurality of wipers will dislodge the ferrous particles as they move pass the magnetic field flux.

A metal separator apparatus utilizing a single magnetic separator disc may have two opportunities to separated non-ferrous metal particles from the residue, while a metal separator apparatus utilizing a two magnetic separator discs may have four opportunities to separated non-ferrous metal particles from the residue. The large dead space in the center of each disc provides the multiple opportunities for discharge of non-ferrous metal particles. On a single disc apparatus, when a non-ferrous metal particle enters the magnetic field flux, it will either be discharges off to the side or it will be carried forward by the conveyor belt over the dead space and again into the magnetic field flux for the particles second opportunity to be separated from the residue. On a two disc apparatus, the non-ferrous metal particles may be carried through both dead spaces and through a magnetic field flux four times, providing the particle with four opportunities to be separated from the residue.

After the residue pass through the magnetic field flux and the non-ferrous metal particles are separated, the remaining residue is dumped off the end of the frame as the conveyor belt moves downward and then back toward the front end to repeat the cycle.

While preferred embodiments of the invention have been shown and described, it will be apparent to those skilled in this art that various modification may be made in these embodiments without departing from the spirit of the present invention. Therefore, the embodiments of the invention in which an exclusive property or privilege is claimed are defined as follows:

What is claimed is:

1. A magnetic separator disc for separating non-ferrous metals from debris comprising:

a circular disc body designed to rotate around a vertical axis, having a top end and a bottom end, said top end having a flat surface and said bottom end having a central aperture for engagement with a bolt, said circular disc body composed of a resilient material;

an cylindrical disc hub, beveled on an upper end, having a central aperture, permanently attached to said bottom end of said circular disc body;

an elongated cylindrical shaft designed to engage with said cylindrical disc hub, having a bore at a top end for receiving said disc bolt, a bottom end having an aperture, an equatorial bore positioned to meet said central aperture of said cylindrical disc hub;

a circumferential ring attached to said top end of said circular disc body forming a boundary around the circumference of said circular disc body;

a plurality of permanent magnets, said plurality of permanent magnets generally rectangular, positioned in a plurality of rows at the circumference of said top end of said circular disc body, said plurality of magnets positioned so as to have alternating polarities, said circumferential ring forming an outer boundary for said plurality of permanent magnets, said plurality of magnets attached to said circular disc body;

a disc cover, circular in shape, thin, composed of resilient material and attached to the top of said circumferential ring, to enclose said top end of said circular disc body and to prevent upward movement of said plurality of magnets;

means for rotating said circular disc body; and means for passing debris containing a plurality of non-ferrous metal particles over said circular disc body;

whereby said rotating of said plurality of permanent magnets attached to said circular disc body creates a magnetic flux field which induces an eddy current in non-ferrous metal particles creating a repulsive force which will levitate and control the movement of said plurality of non-ferrous metal particles, enabling said plurality of non-ferrous metal particles to be separated from said debris.

2. The magnetic separator disc according to claim 1 wherein said plurality of magnets are separated from each other by a plurality of displacement units dispersed between each of said plurality of magnets so as to provide a barrier between magnetic forces of each of said plurality of magnets for each other, and to further divide said plurality of magnets into a plurality of columns of magnets.

3. The magnetic separator disc according to claim 2 wherein said plurality of columns of magnets are divided by a plurality of insulator units dispersed between magnets of similar polarity in order to create a barrier between repulsive forces of said plurality of magnets.

4. The magnetic separator disc according to claim 3 wherein said plurality of magnets are Neodym 35 magnets.

5. The magnetic separator disc according to claim 3 wherein said plurality of displacement units and said plurality of insulator units are composed of a non-magnetic material.

6. The magnetic separator disc according to claim 1 wherein said means for rotating said circular disc body is a motor connected to said elongated cylindrical shaft, said motor rotating said shaft which in turn rotates said circular disc body attached to said shaft.

7. The magnetic separator disc according to claim 1 wherein said circular disc body, said shaft, said disc hub, said circumferential ring and said disc cover are composed of steel.

8. The magnetic separator disc according to claim 1 wherein said magnetic flux field is created above said plurality of magnets, rotation of said magnetic flux field corresponding to and in the direction of said circular disc body rotation, a dead area created above said circular disc body where no magnetic flux field is present, said dead area generally bounded by a circumferential boundary of said magnetic flux field.

9. The magnetic separator disc according to claim 8 wherein said plurality of non-ferrous metal particles in which an eddy current has been induced will move in the general rotation of said magnetic flux field.

10. A metal separator apparatus for separating non-ferrous metal particles from debris comprising:

a skeletal frame having a forward end and a rearward end, a plurality rearward legs located at said rearward end and extending from the top of said skeletal frame to the ground, a plurality of forward legs at said forward end and extending from the top of said skeletal frame to the ground, an upper portion and a lower portion;

a conveyor belt system having a continuous belt which rotates around said skeletal frame, a forward belt drum for rotating said belt attached to said plurality of forward extensions, a rearward belt drum for maintaining the rotation of said conveyor belt attached to said plurality of rearward extensions, a plurality of small belt drums for maintaining the rotation of said conveyor belt, and means for rotating said forward belt drum;

a plurality of discharge chutes for receiving non-ferrous metal particles, located above and to the sides of said conveyor belt, attached to said upper portion of said skeletal frame, each of said plurality of discharge chutes having an opening facing said conveyor belt, each opening of said plurality of discharge chutes funneling non-ferrous metal particles to a collection attachment;

a magnetic separator disc positioned to rotate on an axis perpendicular to a carrying plane of said conveyor belt, attached to said upper portion of said skeletal frame below said conveyor belt, said magnetic separator disc creating a magnetic flux field directed upward which induces an eddy current in non-ferrous metal particles;

means for evenly distributing debris to said conveyor belt located at said forward end of said skeletal frame; and means for receiving said debris after said non-ferrous metal particles have been separated, located at said rearward end of said skeletal frame and below the edge of said conveyor belt;

whereby non-ferrous metal particles in debris which is distributed onto and transported by said conveyor belt is separated out from the other debris material when said non-ferrous metal particles pass over said magnetic field flux created by the rotation of said magnetic separator disc, said eddy current induced in said non-ferrous metal particles creating a repulsive force which levitates said non-ferrous metal particles above said other debris and into said discharge chutes for collection.

11. The metal separator apparatus according to claim 10 wherein said magnetic separator disc comprises:

a circular disc body designed to rotate around a vertical axis, having a top end and a bottom end, said top end having a flat surface and said bottom end having a central aperture for engagement with a bolt, said circular disc body composed of a resilient material;

a cylindrical disc hub, beveled on an upper end, having a central aperture, permanently attached to said bottom end of said circular disc body;

an elongated cylindrical shaft designed to engage with said cylindrical disc hub, having a bore at a top end for receiving said disc bolt, a bottom end having an aperture, an equatorial bore positioned to meet said central aperture of said cylindrical disc hub;

a circumferential ring attached to said top end of said circular disc body forming a boundary around the circumference of said circular disc body;

a plurality of permanent magnets, said plurality of permanent magnets generally rectangular, positioned in a plurality of rows at the circumference of said top end of said circular disc body, said plurality of magnets alternating in polarity, said circumferential ring forming an outer boundary for said plurality of permanent magnets, said plurality of magnets attached to said circular disc body;

a disc cover, circular in shape, thin, composed of resilient material and attached to the top of said circumferential ring, to enclose said top end of said circular disc body and to prevent upward movement of said plurality of magnets;

means for rotating said circular disc body; and whereby said rotating of said plurality of permanent magnets attached to said circular disc body creates a magnetic flux field which induces an eddy current in non-ferrous metal particles creating a repulsive force which will levitate and control the movement of said non-ferrous metal particles, enabling said non-ferrous metal particles to be separated from said debris.

12. A metal separating apparatus for separating non-ferrous metals from debris comprising:

a magnetic separator disc further comprising:

a circular disc body designed to rotate around a vertical axis, having a top end and a bottom end, said top end having a flat surface and said bottom end having a central aperture for engagement with a bolt, said circular disc body composed of a resilient material;

a cylindrical disc hub, beveled on an upper end, having a central aperture, permanently attached to said bottom end of said circular disc body;

an elongated cylindrical shaft designed to engage with said cylindrical disc hub, having a bore at a top end for receiving said disc bolt, a bottom end having an aperture, an equatorial bore positioned to meet said central aperture of said cylindrical disc hub;

a circumferential ring attached to said top end of said circular disc body forming a boundary around the circumference of said circular disc body;

a plurality of permanent magnets, said plurality of permanent magnets generally rectangular, positioned in a plurality of rows at the circumference of said top end of said circular disc body, said plurality of magnets alternating in polarity, said circumferential ring forming an outer boundary for said plurality of permanent magnets, said plurality of magnets attached to said circular disc body;

a disc cover, circular in shape, thin, composed of resilient material and attached to the top of said circumferential ring, to enclose said top end of said circular disc body and to prevent upward movement of said plurality of magnets;

means for rotating said circular disc body; and means for passing debris containing non-ferrous metal particles over said circular disc body;

whereby said rotating of said plurality of permanent magnets attached to said circular disc body creates a magnetic flux field which induces an eddy current in non-ferrous metal particles creating a repulsive force which will levitate and control the movement of said non-ferrous metal particles, enabling said non-ferrous metal particles to be separated from said debris;

means for conveying debris containing non-ferrous metal particles; and means for discharging levitated non-ferrous metal particles into a collection chute.

13. The metal separator apparatus according to claim 12 wherein said means for conveying is a continuous, seamless, non-magnetic conveyor belt.

14. The metal separator apparatus according to claim 12 wherein said means for discharging is the rotation of said magnetic separator disc.

* * * * *